US005277948A

United States Patent [19]

Daun

[11] Patent Number: 5,277,948

[45] Date of Patent: Jan. 11, 1994

[54] ACTION ORNAMENT FOR USE WITH DECORATIVE LIGHT STRING SETS

[75] Inventor: Daniel L. Daun, Hoffman Estates, Ill.

[73] Assignee: Noma International, Inc., Forest Park, Ill.

[21] Appl. No.: 928,733

[22] Filed: Aug. 13, 1992

[51] Int. Cl.[5] ..... B32B 9/00

[52] U.S. Cl. ..... 428/7; 428/11; 428/16; 428/18; 428/19; 362/806; 362/809; 315/185 S; 315/185 R; 315/179; 40/414; 40/432

[58] Field of Search ..... 428/16, 7, 11, 18, 19; 362/806, 809, 35; 40/414, 432; 315/185S, 185R

[56] References Cited

U.S. PATENT DOCUMENTS

| | | | |
|---|---|---|---|
| 3,233,090 | 2/1963 | Wagner | 362/35 |
| 4,875,886 | 10/1989 | Sung | 428/16 |
| 4,980,608 | 12/1990 | Morrison | 315/185 |
| 4,987,787 | 1/1991 | Hou | 428/16 |

*Primary Examiner*—Patrick J. Ryan
*Assistant Examiner*—Abraham Bahta
*Attorney, Agent, or Firm*—Kirschstein, Ottinger, Israel & Schiffmiller

[57] ABSTRACT

A mobile decorative part of a Christmas tree ornament is orbited around a stationary decorative part by an electrical motor locked onto the stationary decorative part.

19 Claims, 2 Drawing Sheets

ACTION ORNAMENT FOR USE WITH DECORATIVE LIGHT STRING SETS

BACKGROUND OF THE INVENTION

1. Field of the Invention

This invention generally relates to a holiday ornament for hanging on an object, for example, a Christmas tree and, more particularly, to an action ornament having a mobile decorative part orbited around a stationary decorative part to create an animated visual effect.

2. Description of Related Art

A Christmas tree ornament having an internal DC motor powered by external batteries and operative for moving movable decorative parts relative to stationary decorative parts is disclosed in U.S. Pat. No. 4,923,721. U.S. Pat. No. 4,989,120 discloses another Christmas tree ornament having an internal motor for moving a movable part including a lamp, the motor being powered through a connector plugged into an electrical lamp socket of a light string set. U.S. Pat. No. 4,980,608 discloses a miniature electrical motor specifically adapted to be plugged into a lamp socket of a light string set and operative to rotate Christmas tree ornaments. U.S. Pat. Nos. 4,146,919 and 4,214,296 are exemplificative of rotating hanging lamps with internal motors.

The known use of an external motor to rotate an entire holiday ornament has not proven altogether satisfactory in practice because the ornament can become detached from the motor, and fall to the ground and shatter. This detachment problem can be prevented by using an internal motor. However, this increases the overall size of the ornament and renders it too bulky and too heavy for some decorative applications.

SUMMARY OF THE INVENTION

1. Objects of the Invention

It is a general object of this invention to provide an ornament with an enhanced animated action effect.

It is another object of this invention to provide an economical and reliable ornament with a unique movement.

Another object of this invention is to create an esthetic visual impression by orbiting a mobile decorative part of an ornament around a stationary decorative part.

A further object of this invention is to resist detachment between an external motor and an action ornament powered thereby.

2. Features of the Invention

In keeping with these objects, and others which will become apparent hereinafter, one feature of this invention resides, briefly stated, in an action ornament for use with a decorative light string set of incandescent lamps removably mounted in lamp sockets. The ornament comprises a stationary decoration, a mobile decoration and a drive shaft extending along an axis through the stationary decoration and having shaft ends located exteriorly of the stationary decoration. The mobile decoration is supportably positioned exteriorly of the stationary decoration by a support means connected to one of the shaft ends. An electrical motor has a motor housing and an output shaft which is operatively connected to the other of the shaft ends. An electrical plug electrically connects the motor to one of the lamp sockets from which one of the lamps has been removed in order to energize the motor to turn the drive shaft, and in order to orbit the mobile decoration around the stationary decoration.

In further accordance with this invention, locking means are provided for resisting turning movement between the motor housing and the stationary decoration during orbiting of the mobile decoration. The locking means reliably prevents accidental detachment between the motor housing and the stationary decoration.

In the preferred embodiment, the drive shaft extends vertically along the axis entirely through and past top, bottom and interior portions of the stationary decoration. A coupling ring is located above the stationary decoration and is engaged by a hook provided on the output shaft of the motor. The other shaft end of the motor extends below the stationary decoration and is fixed to a hub portion from which an arm extends outwardly to support the mobile decoration. The arm may extend linearly or curvilinearly away from the hub portion.

In the preferred embodiment, the locking means is constituted by a holder integral with the stationary decoration and having walls bounding an opening in which the motor housing is frictionally received. The motor housing has opposite planar side walls which make planar surface engagement with the holder walls which are also planar and opposite each other.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
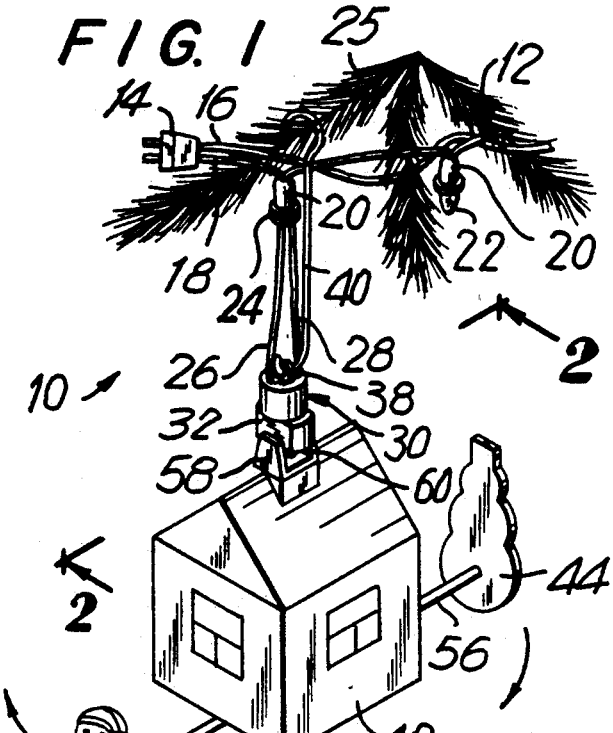
FIG. 1 is a perspective view of an action ornament according to one embodiment of this invention.
Figure 2:
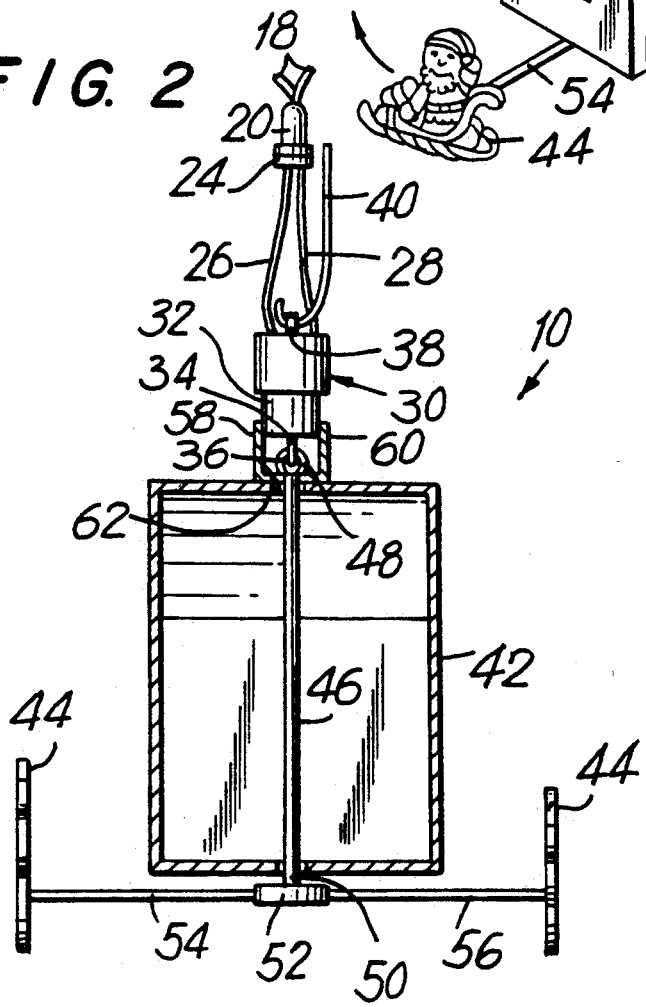
FIG. 2 is an enlarged, sectional view taken on line 2—2 of FIG. 1.

Referring now to FIGS. 1 and 2 of the drawings, reference numeral 10 generally identifies a first embodiment of an action ornament for use with a decorative light string set 12 shown in broken-away view. The light string set 12 is entirely conventional and forms no part of this invention. The set 12 is well known in the art and, for example, one is disclosed in U.S. Pat. No. 4,980,608, the entire contents of which are hereby incorporated by reference herein. The set 12 includes an electrical power plug 14 designed to fit into a normal wall socket that supplies electrical AC power along a pair of conductors 16, 18 to a plurality of series-connected lamp sockets 20 in which a corresponding plurality of lamps 22 have bases that are press-fitted into the sockets 20. The set 12 is typically strung along and supported on the branches of a Christmas tree, a portion of one branch 24 being shown in broken-away view.

The ornament 10 is used with such a known set. As will be described in greater detail below, an electrical motor plug 24 is similar in construction to the normal press-fitted base of a respective lamp 22. One of the lamps 22 is removed from one of the sockets 20, and the motor plug 24 is inserted into the vacant socket 20. The motor plug 24 carries electrical conductors 26, 28 which bring electrical power from the conductors 16, 18 to the ornament and, more particularly, to an electrical motor 30.

The motor 30 is identical to the electrical motor rotator described in U.S. Pat. No. 4,980,608 and, for the sake of brevity, the entire contents of said patent are incorporated herein by reference. Motor 30 is a permanent magnet inductor motor whose impedance is equivalent to one of the incandescent lamps so as to be fully interchangeable therewith. Motor 30 includes a housing 32 in which a gear train is contained for reducing the speed of rotation of an output motor shaft 34 to a speed on the order of 12 rpm, again, as explained in said patent. The motor shaft 34 has a lower end formed with a hook 36. The top of the motor includes a mounting ring 38 to which a hanger 40 is hooked to facilitate hanging the motor 30 to the tree branch 24.

The ornament 10 of FIG. 1 includes a stationary decoration 42 shown as a three-dimensional house, and mobile decorations 44 shown as a Santa Claus figurine on a sleigh and a snowman figurine. As best seen in FIG. 2, a drive shaft 46 extends along a vertical axis through the stationary decoration 42 and has an upper end formed as a coupling ring 48 above the stationary decoration 42 for attachment to the hook 36, and a lower end 50 fixedly inserted into a hub 52 for joint rotation therewith. At least one arm, and preferably two arms 54, 56 extend linearly radially outwardly from the hub 52 to the mobile decoration 44.

A pair of generally planar parallel locking walls 58, 60 extend upwardly from the stationary decoration 42. These walls are advantageously externally ornamented so as not to detract from the overall beauty of the ornament. In this case, the locking walls are configured to resemble a chimney. The locking walls 58, 60 are spaced apart and bound an opening 62 into which a portion of the housing 32 is situated. The housing 32 is likewise provided with parallel planar side walls for frictionally engaging the locking walls 58, 60 in surface engagement. When the housing 32 is fitted into the opening 62, relative turning movement between the housing and the stationary decoration 42 is reliably prevented.

When the motor 30 is energized, the motor shaft 34 rotates and, in turn, the drive shaft 46 rotates jointly with the arms 54, 56, and the mobile decorations 44 are orbited around the stationary decoration 42. During such orbiting movement, there is no tendency for the stationary decoration 42 to rotate because it is locked to the motor housing 32.

Figure 3:
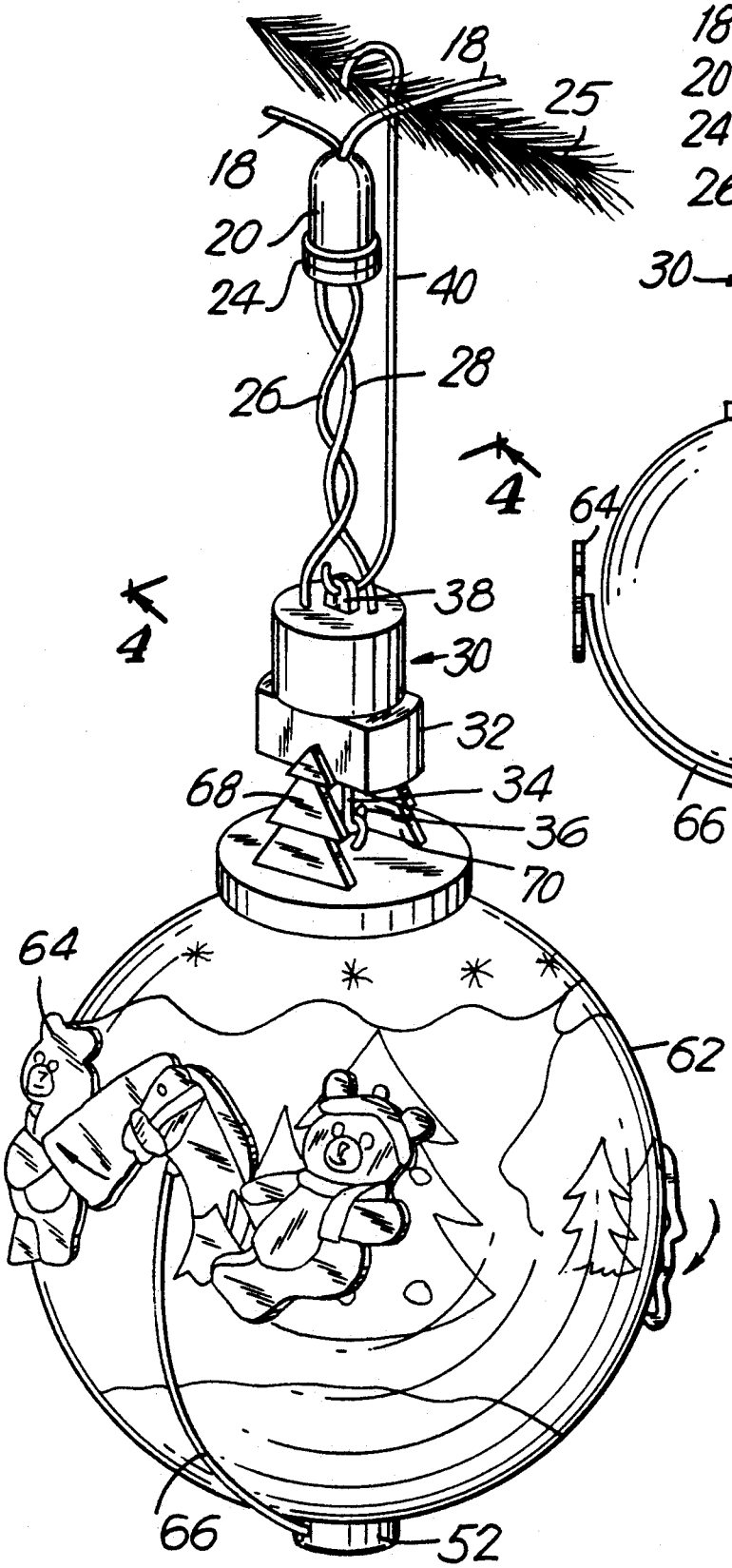
FIG. 3 is a perspective view of an action ornament according to another embodiment of this invention.
Figure 4:
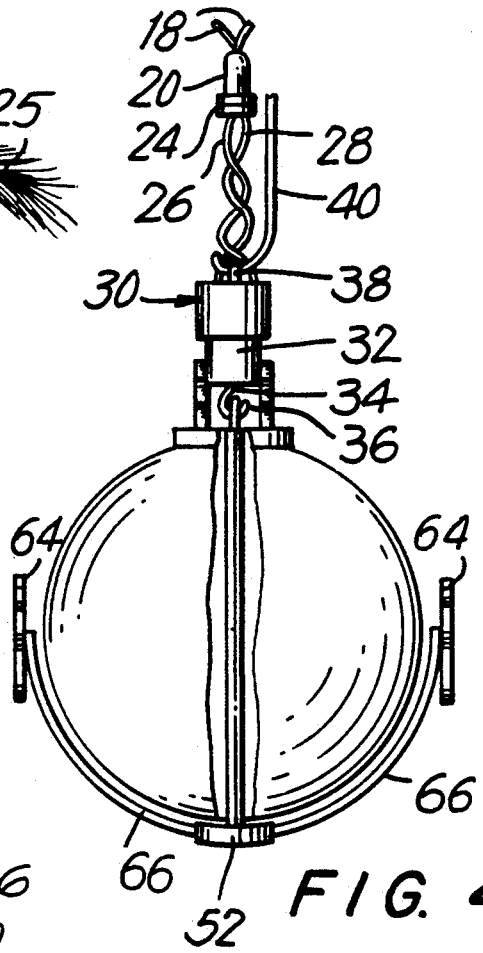
FIG. 4 is a sectional view on a reduced scale taken on line 4—4 of FIG. 3.

As shown in the second embodiment of an ornament in FIGS. 3 and 4, like reference numerals have been used to identify like parts with those of the first embodiment. The following differences should be noted. A stationary decoration 62 is shaped as a spherical globe, rather than as the house-shaped stationary decoration 42. A mobile decoration 64 is shaped as a series of interconnected bear-like figurines, rather than as individual figurines of different design. Support arms 66 extend curvilinearly outwardly and upwardly of the hub 52, rather than entirely radially as in the case of the arms 54, 56. The locking walls 68, 70 are configured as fir trees, rather than as chimney walls 58, 60.

It will be appreciated that the stationary decoration can have shapes other than the house or globe illustrated and, indeed, any design may be employed. The same is true for the mobile decorations. As the mobile decorations orbit around the stationary decoration, the motor 30 and the stationary decoration remain stationary despite the orbiting movement and, of course, the tendency for the stationary and mobile decorations to become detached from the motor 30 is overcome.

It will be understood that each of the elements described above, or two or more together, also may find a useful application in other types of constructions differing from the types described above.

While the invention has been illustrated and described as embodied in an action ornament for use with decorative light string sets, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. An action ornament for use with a decorative light string set of incandescent lamps removably mounted in lamp sockets, comprising:

(a) a stationary decoration;

(b) a drive shaft extending along an axis through the stationary decoration and having opposite shaft ends located exteriorly of the stationary decoration;

(c) a mobile decoration;

(d) support means connected to one of the shaft ends, for supportably positioning the mobile decoration exteriorly of the stationary decoration;

(e) an electrical motor having a motor housing and an output shaft operatively connected to the other of the shaft ends;

(f) plug means for electrically connecting the motor to one of the lamp sockets from which one of the lamps has been removed, for energizing the motor to turn the drive shaft, and for orbiting the mobile decoration around the stationary decoration; and (g) locking means for resisting turning movement between the motor housing and the stationary decoration during orbiting of the mobile decoration.

2. The ornament according to claim 1, wherein the stationary decoration has a top, a bottom and an interior; and wherein the drive shaft extends vertically along the axis entirely through and past the top, bottom and interior of the stationary decoration.

3. The ornament according to claim 1, wherein said one shaft end has a coupling ring located above the stationary decoration, and wherein the output shaft of the motor has a hook for engaging the coupling ring.

4. The ornament according to claim 1, wherein said other shaft end extends below the stationary decoration, and wherein the support means has a hub portion fixed to said other shaft end, and an arm extending outwardly from the hub portion to the mobile decoration.

5. The ornament according to claim 4, wherein the arm extends linearly and radially of the axis.

6. The ornament according to claim 4, wherein the arm extends curvilinearly outwardly and upwardly away from the hub portion.

7. The ornament according to claim 4; and further comprising another arm extending outwardly from the hub portion to the mobile decoration, both arms extending from opposite sides of the hub portion.

8. The ornament according to claim 1, wherein the locking means is a holder on the stationary decoration, said holder having holder walls bounding an opening in which the motor housing is frictionally received.

9. The ornament according to claim 8, wherein the motor housing has opposite planar side walls, and wherein the holder walls are also planar and opposite each other.

10. The ornament according to claim 1; and further comprising hanger means for suspending the ornament from an object to be decorated.

11. In combination, an ornament for a Christmas tree of the like, said ornament having a decorative body part; a shaft having an axis therealong; means mounting said shaft to said decorative body part for rotation with respect thereto; said shaft having a first end, said first end locating externally of said body part, a decorative element actuated body movement of said shaft; a drive motor for said ornament; means for drivingly coupling said first end of said shaft to a drive motor, said drive motor including a casing; static coupling means associated with said decorative body part for telescopically receiving at least a portion of said motor housing therein to prevent the relative rotation of said casing and said decorative body part.

12. An ornament as claimed in claim 11, wherein said static coupling means comprises a pair of axially aligned walls locating on transversely opposed sides of said first end.

13. An ornament as claimed in claim 11, wherein said shaft has a second end which locates externally of said body part, and said decorative element is supported form said shaft at said second end thereof.

14. An ornament as claimed in claim 11, wherein said means for drivingly coupling said first end of said shaft to said drive motor acts to suspend said ornament from said drive motor.

15. An animatable ornament for a Christmas tree of the like, said ornament comprising an decorative stationary body part; a shaft having an axis therealong; means mounting said shaft to said stationary body part for rotation about said axis with respect to said stationary body part; said shaft having a first end locating externally of said static body part; a looped element disposed on said first end for dynamically coupling said ornament to a cooperating looped element disposed on the drive shaft of a drive motor and static coupling means associated with said stationary body part for coupling said stationary body part to said motor, said static coupling means serving to prevent the rotation of said stationary body part about said axis and to restrict the manner in which said looped elements may be coupled and uncoupled together.

16. An ornament as claimed in claim 15, wherein said static coupling means comprises wall means partially surrounding said first end of said shaft for receiving a portion of the housing of said motor therebetween.

17. An ornament as claimed in claim 15, wherein said static coupling means comprises a pair of axially aligned wall locating on transversely opposed sides of said first end.

18. An ornament as claimed in claim 15, wherein said shaft has a second end which locates externally of said body part, and said decorative element is supported from secured to said shaft at said second end thereof.

19. An ornament as claimed in claim 15, wherein said looped element disposed on said first end of said shaft is intended to suspend said ornament from said drive motor.

* * * * *